US007335289B2

(12) United States Patent
Haiki et al.

(10) Patent No.: US 7,335,289 B2
(45) Date of Patent: Feb. 26, 2008

(54) HIGH PURITY ELECTROLYTIC COPPER AND ITS PRODUCTION METHOD

(75) Inventors: Kenji Haiki, Shinagawa (JP); Kazuhiko Motoba, Hitachi (JP); Hiroshi Oda, Hitachi (JP)

(73) Assignees: Nippon Mining & Metals Co., Ltd., Tokyo (JP); Mitsui Mining and Smelting Co., Ltd., Tokyo (JP)

( * ) Notice: Subject to any disclaimer, the term of this patent is extended or adjusted under 35 U.S.C. 154(b) by 546 days.

(21) Appl. No.: 10/915,401

(22) Filed: Aug. 11, 2004

(65) Prior Publication Data

US 2005/0067291 A1 Mar. 31, 2005

(30) Foreign Application Priority Data

Sep. 30, 2003 (JP) ..... 2003-340335

(51) Int. Cl.
*C25C 1/12* (2006.01)

(52) U.S. Cl. ..... 205/575; 205/574; 205/586; 205/111

(58) Field of Classification Search ..... 205/574, 205/575, 586, 111
See application file for complete search history.

(56) References Cited

U.S. PATENT DOCUMENTS 5,487,819 A 1/1996 Everett
5,837,119 A * 11/1998 Kang et al. ..... 205/74

FOREIGN PATENT DOCUMENTS

JP 2857930 B2 12/1998
WO WO-94/00606 A1 1/1994

* cited by examiner

*Primary Examiner*—Bruce F. Bell
(74) *Attorney, Agent, or Firm*—Birch, Stewart, Kolasch & Birch, LLP

(57) ABSTRACT

A method of producing high purity electrolytic copper through halide-bath electrowinning is provided. The method includes the steps of: growing copper in dendritic form to be deposited on a cathode; and recovering growth ends of 3.0 mm or shorter from the dendrites.

8 Claims, 4 Drawing Sheets

HIGH PURITY ELECTROLYTIC COPPER AND ITS PRODUCTION METHOD

This Non-provisional application claims priority under 35 U.S.C. 119(a) on Patent Application No(s). 2003-340335 filed in Japan on Sep. 30, 2003, the entire contents of which are hereby incorporated by reference.

BACKGROUND OF THE INVENTION

1. Field of the Invention

The present invention generally relates to high purity electrolytic copper and a method of producing the high purity electrolytic copper, and more particularly, to a method of electrowinning high purity copper in a halide bath.

2. Description of the Related Art

Copper electrowinning is performed to leach copper from ores and other materials in a solution, and to electrolytically reduce the leached copper ions to form electrolytic copper to be put on the market. Copper electrowinning methods of this type include a method of electrowinning copper in a sulfate bath and a method of electrowinning copper in a halide bath.

The method of electrowinning copper in a sulfate bath has been put into practice, and it has been proved that electrolytic copper of the same quality as the quality of electrorefining copper, which is the normal electrolytic copper, can be obtained by the method. On the other hand, by the method of electrowinning copper in a halide bath, electrodeposited metals in plate-like form cannot be obtained, and the electrodepositing form varies from particle form to dendritic form. Under such conditions, electrolytic copper that has high enough quality to be put on the market cannot be obtained. This has constituted a great hindrance in leaching ores and electrowinning copper through hydrometallurgical processing in a chloride bath that excels in copper leaching ability and copper solubility. Particularly, as sulfuric acid is not very effective for the leaching of chalcopyrite, it is desirable to perform leaching in a chloride bath. However, the above mentioned reason has remained a great hindrance in doing so.

When electrowinning is performed in a halide bath, a large quantity of additives such as gelatin is conventionally used with a current density of 100 $A/m^2$ or lower, so as to obtain electrodeposited metals in plate-like form. However, productivity is very low with such a low current density, and sufficient electrodeposition in plate-like form cannot be expected with a higher current density. U.S. Pat. No. 5,487,819 discloses a method of producing high quality electrolytic copper through the formation of dendrites using dimpled cathodes with a current density of 500 $A/m^2$ to 1000 $A/m^2$ (Intec process). However, the method has not proved to be successful in steady production of electrolytic copper having a purity corresponding to the purity of electrorefining copper. Furthermore, the dendrite deposition presents a problem of the deposited copper in dendritic form being hooked or hung in electrolytic cells, making it difficult to scrape off and remove the deposited copper from electrodes.

SUMMARY OF THE INVENTION

It is therefore an object of the present invention to provide high purity electrolytic copper and a method of producing the high purity electrolytic copper in which the above disadvantage is eliminated.

A more specific object of the present invention is to provide a method of producing high quality electrolytic copper through halide-bath electrowinning, by which the electrolytic copper can be easily removed from electrolytic cells.

(1) According to an aspect of the present invention, there is provided high purity electrolytic copper that is obtained through electrowinning in a halide bath and electrolytic recovery, comprising dendrites, 95 mass % or more of which are 3.0 mm or smaller in particle size.

(2) According to another aspect of the present invention, there is provided a method of producing high purity electrolytic copper through halide-bath electrowinning, comprising the steps of: growing copper in dendritic form, the copper to be deposited on a cathode; and recovering growth ends of 3.0 mm or shorter from the dendrite tops.

(3) This method may be modified so that electrolysis is performed while adjusting current so that the potential of the cathode stays in the range of −50 to −150 mV/SHE.

(4) The method may be modified so that the cathode has convex sections and insulated concave sections, each of the convex sections being 3 mm or smaller in width and having side surfaces at an angle of 80 to 110 degrees.

(5) The method may be modified so that all electrodeposits or almost all electrodeposits are scraped off the convex sections of the cathode at regular time intervals.

(6) The method may be modified so that the convex sections are made of Ti or Cu.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
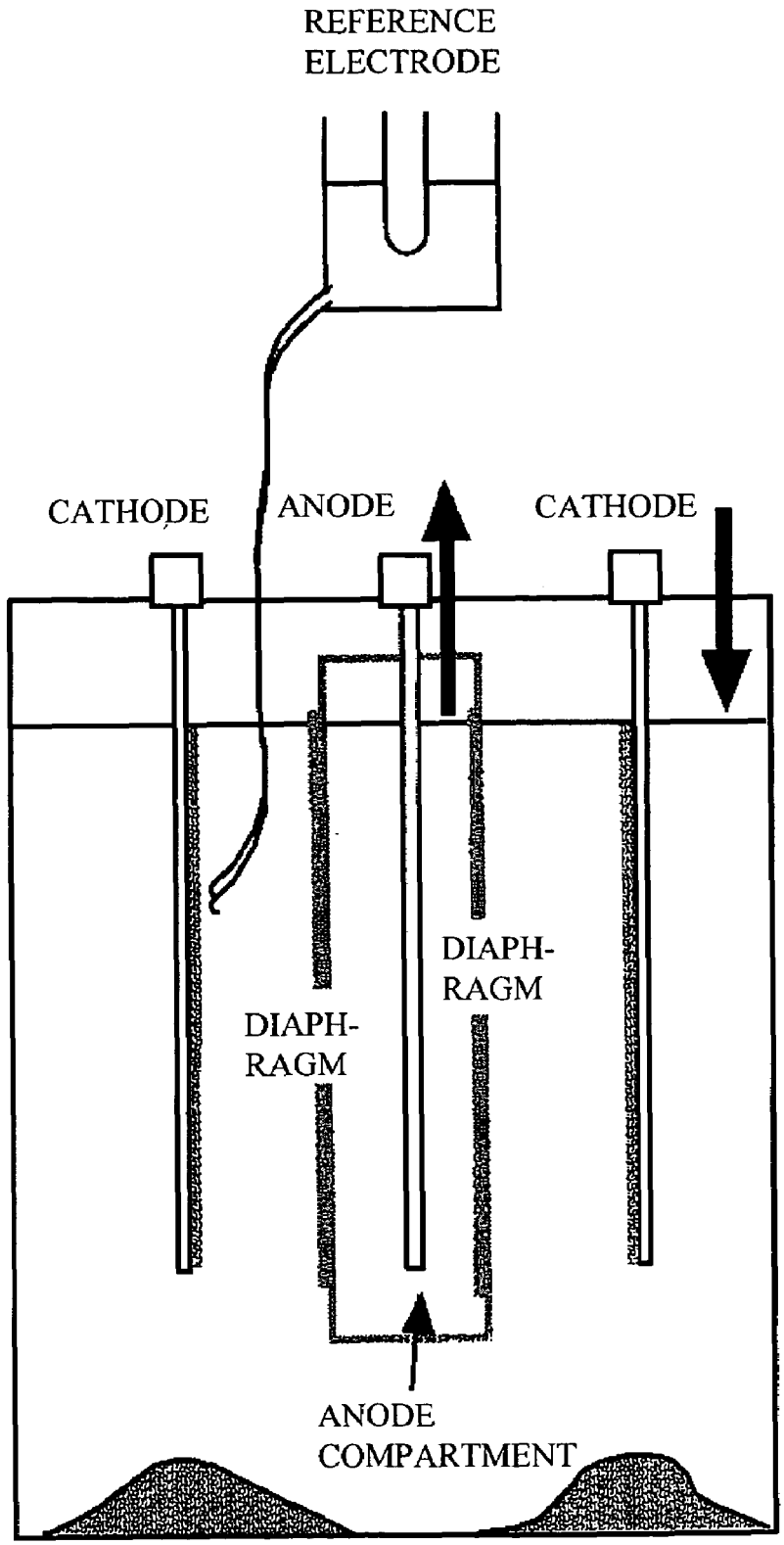
FIG. 1 illustrates an apparatus for electrowinning.

The following is a detailed description of the present invention.

The inventors of the present invention paid attention to the fact that there was the case that high quality dendrite deposition could take place in copper electrowinning in a halide bath. Based on this fact, the inventors made further studies to discover that dendrite deposition could take place with spherical diffusion layers formed locally on the edges of crystals, instead of linear diffusion layers, and that each crystal was a copper single crystal as the supply of copper ions became abundant. It was also found that copper having a purity corresponding to the purity of electrorefining copper could be obtained.

The inventors also learned that there were great variations in the quality (separating classifier) of copper produced through dendrite deposition, and that it was difficult to constantly produce high quality electrolytic copper. The inventors considered that this was because the dendrites grew into a two-dimensional or more complex crystalline structure, and in the growing process, inclusion of liquid among crystals was caused. The inventors then extracted finer copper particles by quickly scraping off the copper particles only from the crystalline edges where the spatial dimension in terms of dendrite growth is low, and classified and analyzed the copper particles. As a result, it was found that adverse influence of the inclusion of liquid was very small. If 95 mass % or more of the copper particles obtained here are dendrites of 3.0 mm or smaller in particle size, high purity electrolytic copper containing only 10 mass ppm or less of impurities, such as chloride, sodium, and sulfur, can be obtained.

For the above reason, deposited copper should be scraped off in the dendrite edge growing stage, so that 95 mass % or more of the crystals are still as small as 3.0 mm or less in particle size. In this manner, high quality crystals can be obtained.

However, it became apparent that it was difficult to scrape off only the edges of dendrites, because dendritic crystals were so fragile as to break at the base and drop down. Also, where scraping-off was repeatedly performed on the crystalline surface in the above manner, crystals were piled up between the electrode and the scraper, and effective scraping-off became impossible.

As a scraping-off technique, it is possible to employ a technique of peeling off electrodeposited crystals by sweeping the electrode surface with a movable unit that is placed at a certain distance from the electrode surface. When the nature of dendritic crystals is taken into consideration, however, it is apparent that crystal pile-up and pile growth cannot be avoided in any way. Therefore, crystals electrodeposited on the electrode surface need to be totally removed.

Where the technique of totally removing crystals from an electrode surface is employed, however, spherical diffusion layers are not formed on the edges of dendrites on the surface of a normal plate-like electrode, and the copper ion supply onto the electrode surface is linearly diffused and decreases in volume. Also, the electrolysis potential becomes a base potential, and the purity of electrodeposited crystals greatly decreases. Once this occurs, satisfactory effects cannot be achieved even by combining the total removal technique with a liquid stirring technique.

Figure 2:
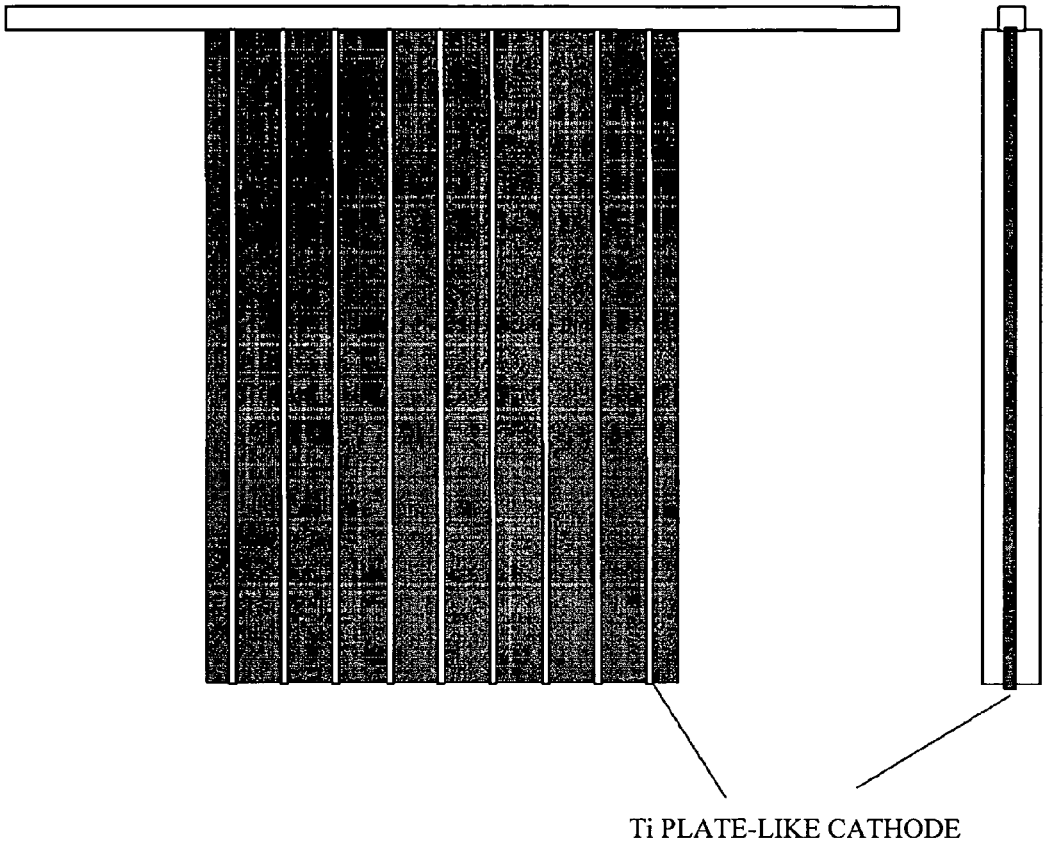
FIG. 2 illustrates a Ti plate-like cathode, with the gray-colored area indicating the insulated area.
Figure 3:
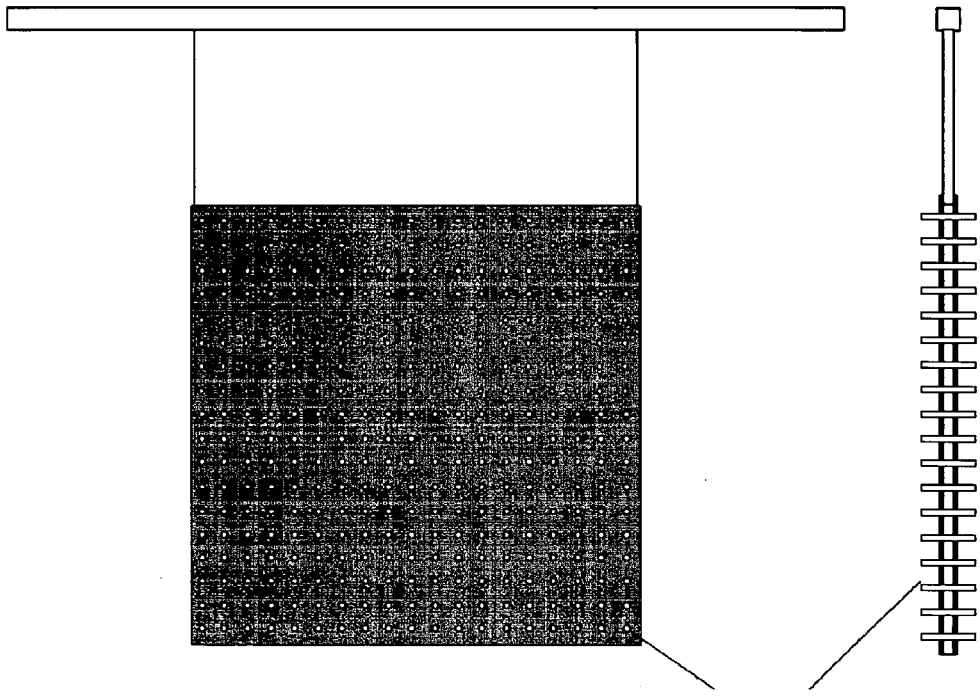
FIG. 3 illustrates a Ti rod-like cathode, with the gray-colored area indicating the insulated area.
Figure 4:
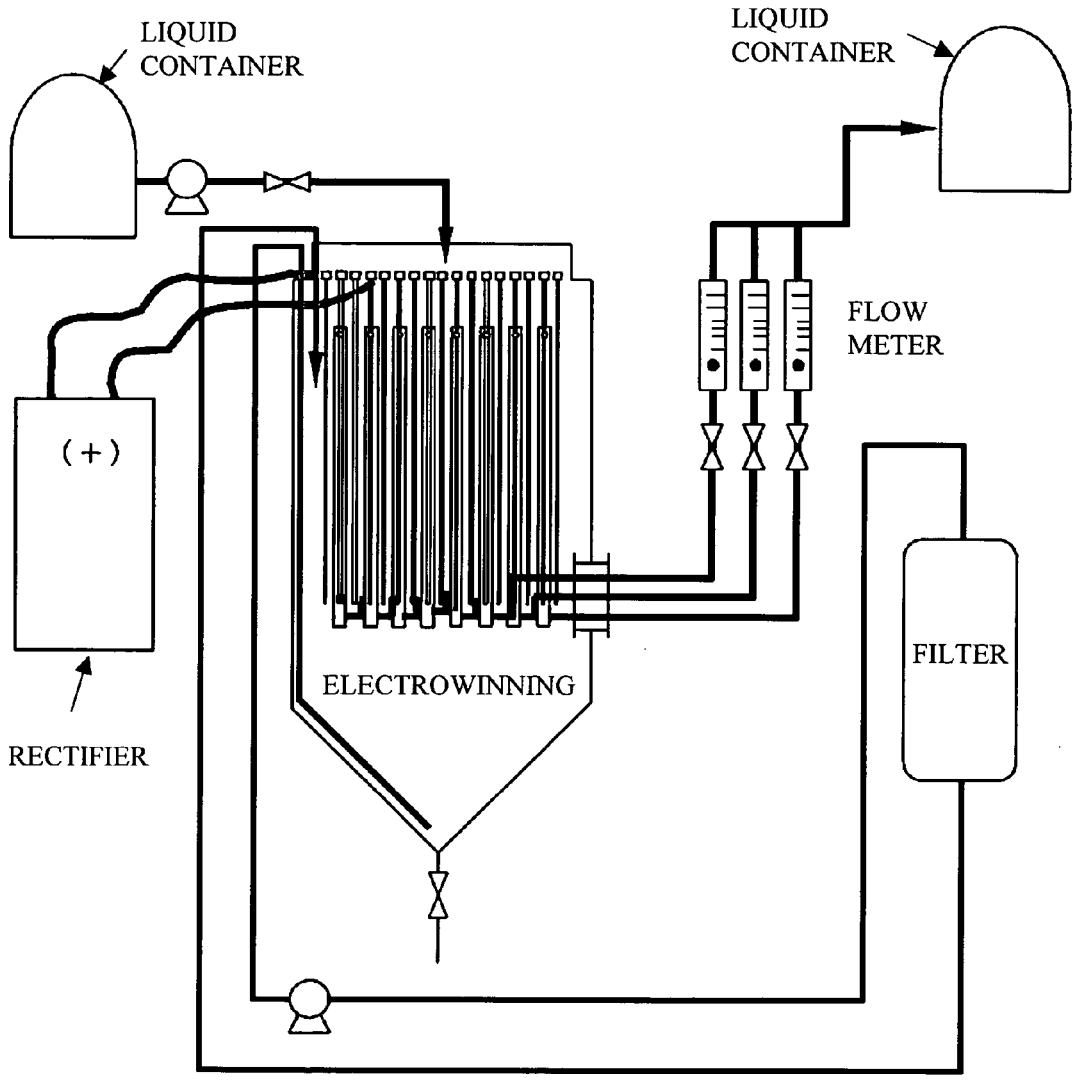
FIG. 4 illustrates a large-sized apparatus for electrowinning.

So as to solve the above problems, the inventors developed electrodes having convex portions arranged in rows, as shown in FIGS. 2 and 3.

FIG. 2 shows an electrode that has a Ti plate welded to a Cu plate in a vertically parallel state. The Ti plate forms convex portions, and the Cu plate forms concave portions and serves as a substrate material. FIG. 3 shows an electrode that has Ti wires fixed into holes formed in a polyvinyl chloride mother board. Although not shown in the figure, the Ti wires are gathered in the electrode and are connected to a conductive wire at the top. The Ti wires form the convex portions, and the polyvinyl chloride mother board forms the concave portions and serves as a substrate material. The side surfaces of those electrode convex portions need to stand vertically from the substrate material, preferably at an angle of 80 to 110 degrees from the surface of the substrate material.

More preferably, the angle should be 88 to 92 degrees, which is closer to a right angle (90 degrees). In a plan view, the electrode structure may have an arrangement in which the convex portions are arranged in a lattice-like fashion, or the convex portions are arranged in such a manner as to increase in number toward the bottom. Also, it is possible to arrange the convex portions in a serpentine-like fashion or a loop-like fashion.

As it is difficult to produce spherical diffusion layers with a flat-type electrode in the early stage of electrolysis, particulate deposition takes place in the beginning of electrodeposition. Dendrite deposition then occurs only under good conditions. However, the above electrode structure intentionally creates a situation of producing spherical diffusion layers, so that Cu single-crystalline electrodeposition can take place in the beginning of the electrodeposition.

If the concave portions of the electrode structure of the present invention are left uninsulated, unstable particulate electrodeposition or porous plate-type electrodeposition occurs, lowering the quality of the deposition and making the scraping-off difficult. As the scraping-off becomes difficult, copper gradually accumulates in the concave portions, and starts burying the convex portions. To avoid such an undesirable situation, the concave portions should be insulated. As the electrode structure of the present invention selectively has conductive and non-conductive surfaces, total removal of electrodeposits does not cause any trouble, and various techniques can be employed for scraping-off.

Furthermore, if the above method is combined with a method of controlling a potential to remain in the range of −50 mV to −150 mV with respect to SHE (Standard Hydrogen Electrode), a higher current density can be used, and the productivity per unit cell can be increased. Also, high quality can be more constantly provided.

In a case where the potential is higher than −50 mV, a high current density cannot be used, and electrodeposition in porous plate-like form occurs, instead of electrodeposition in dendritic form. As a result, inclusion of liquid is frequently caused. In a case where the potential is lower than −150 mV, a higher current density can be used, but copper ions become short in supply. In such a condition, only particulate deposition occurs, resulting in eutectoid of impurity base metals. With the eutectoid, the quality becomes poorer.

The material for cathodes should preferably be Ti or Ti alloy, because Ti or Ti alloy can ensure effective scraping-off of electrodeposits, exhibit high resistance to corrosion in a halide bath, and lower the costs.

In copper removal from an electrolytic cell, 95 mass % or more of dendrites are made 3 mm or smaller in particle size, so that the conventional problems with the pump suction of particulate copper slurry and the scraping-off of copper particles can be avoided. In this manner, there is no such trouble that part of the bigger dendrites causes hanging or a pipe to be clogged, and desirable continuous operation can be performed. Also, this method does not require handling of electrodes after deposition in plate-like form. Such a process of exchanging electrodes with other ones, which has been carried out in the conventional sulfate bath electrowinning, is very costly in terms of installation and labor. Accordingly, this method proves to be cost effective.

The present invention can achieve the following effects:

1) The quality of deposited copper is dramatically improved. High purity copper having a purity corresponding to the purity of conventional electrorefining copper can be obtained with few variations in quality level. Particularly, high quality copper of 99.99 mass % or higher in purity can be obtained, with Cl being 10 mass ppm or less, Na being 5 mass ppm or less, and S being 7 mass ppm or less.

2) In scraping-off of crystals, handling of electrodes is not necessary. Thus, copper recovery can be performed at a lower cost.

In an embodiment of the present invention, a diaphragm electrolytic cell in which an anode compartment and a cathode compartment are separated from each other by diaphragms is employed. A leach liquor obtained from chloride leaching of chalcopyrite is fed as an electrolyte into the cathode compartment, and copper is electrowon through electrolytic reduction carried out on the cathode surface.

After the copper concentration decreases in the cathode compartment, the electrolyte permeates to the anode compartment. Electrolytic oxidation is then carried out in the anode compartment, and the electrolyte is removed from the anode compartment.

The cathodes should preferably be arranged at a distance of 10 mm from the electrode surfaces in the vertical and horizontal directions. Each of the cathodes is a Ti plate of 0.5 mm in thickness and 5 mm in height. The areas other than the convex portions of the Ti plates are insulated.

Current is applied to the entire area of each cathode (the entire area of each Ti plate) with a current density of 500 $A/m^2$, thereby performing electrolysis. A comb-like scraper having teeth at intervals corresponding to the thickness of each Ti plate is vertically moved once in several minutes or several tens of minutes, so that the electrodeposited copper particles are scraped off. In the following, specific examples of the present invention will be described in detail.

EXAMPLE 1

An electrolytic cell shown in FIG. 1 was employed, and a cathode of 140 mm×100 mm in external size, shown in FIG. 2, was used. The cathode was prepared by welding nine Ti plates of 140×12×0.5 mm to a copper crossbar, and sandwiching each Ti plate with polyvinyl chloride (PVC) plates of 140×10×3 mm. The Ti plates are then bonded and fixed.

A chalcopyrite leach liquor (Cl: 5.5 M, Cu: 30 g/L, Zn: 20 g/L, Pb: 3 g/L, Fe: 1 g/L, As: 20 mg/L, Sb: 1 mg/L, Bi: 3 mg/L, Ni: 10 mg/L, Ca: 0.1 g/L) was produced as a sample liquor of the electrolyte for the inside of the electrolytic cell, and a compound liquor of 75 g/L in Cu concentration was supplied as a feed liquor for the electrolytic cell.

The liquor was maintained at approximately 60 degrees C., and electrowinning was performed with a current density of 500 $A/M^2$. The cathode potential was −80 to −150 mV/SHE.

Scraping-off was carried out every three minutes, and copper particles were collected through a total removal process. The copper particles were then subjected to hydrochloric acid washing and water cleaning, followed by drying. Thus, a particulate copper sample was obtained. The results are shown as Examples 1-1 and 1-2 in Table 1 (shown below).

In Examples 1-1 and 1-2, the amounts of Cl were 8 mass ppm and 10 mass ppm, the amounts of Na were 4 mass ppm and 5 mass ppm, and the amounts of S were 5 mass ppm and 3 mass ppm, each of which was quite small. The amount of any other material contained was as small as 1 mass ppm or less.

From this fact, it was apparent that high quality electrolytic copper of 99.99 mass % or higher in purity was obtained. Of the cooper particles obtained, 95% or more were 3.0 mm or smaller in particle size.

EXAMPLE 2

The same electrolytic cell and the same electrolyte as those of Example 1 were employed, and the cathode shown in FIG. 3 was used. This cathode was prepared by forming holes of approximately 0.5 mm in diameter at 5 mm intervals in a PVC mother board. Ti wires of 0.5 mm in diameter were put through the respective holes, and were fixed so as to protrude from the surface of the mother board by approximately 5 mm. The Ti wires were gathered in the electrode and were connected to a conductive wire at the top.

The cathode potential was −100 to −150 mV/SHE.

The other conditions were the same as those of Example 1, and scraping-off was performed with a polypropylene brush every five minutes. The results are shown as Examples 2-1 and 2-2 in Table 1.

In Examples 2-1 and 2-2, the amounts of Cl were 9 mass ppm and 8 mass ppm, the amounts of Na were 4 mass ppm and 4 mass ppm, and the amounts of S were 5 mass ppm and 7 mass ppm, each of which was quite small. The amount of any other material contained was as small as 1 mass ppm or less.

From this fact, it was apparent that high quality electrolytic copper of 99.99 mass % or higher in purity was obtained. Of the copper particles obtained, 95% or more were 3.0 mm or smaller in particle size.

COMPARATIVE EXAMPLES 1 THROUGH 7

Experiments using a Ti flat plate or a Cu corrugated plate as a cathode were carried out in Comparative Examples. Although the sample liquor and the electrolysis conditions were the same as those of Examples, scraping-off was performed only every 30 minutes, and the scraping-off method involves a stick for scraping off dendrites at the base.

Comparative Examples 1 through 7 in Table 1 are the results of the experiments using a normal flat-type electrode.

As can be seen from Table 1, the amounts of Cl were 45 to 78 mass ppm, the amounts of Na were 20 to 35 mass ppm, and the largest amount of S was 8 mass ppm, each of which was larger than each corresponding value of Examples.

As for the other impurities, the amounts of zinc were as large as 1 to 1.3 mass ppm, and the amounts of lead were as large as 0.5 to 1.9 mass ppm.

Judging from these results, it is apparent that only low quality electrolytic copper of 99.99 mass % or lower in purity can be obtained.

Also, the dendrites obtained in Comparative Examples 1 through 7 were several millimeters to 30 mm in particle size, which are larger than those obtained in Examples.

COMPARATIVE EXAMPLES 8 THROUGH 14

Electrowinning using a corrugated electrode was performed with the same electrolyte as that of Example 1.

As can be seen from Table 1, the amounts of Cl were 52 to 110 mass ppm, the amounts of Na were 23 to 34 mass ppm, and the largest amount of S was 10 mass ppm, each of which was larger than each corresponding value of Examples.

As for the other impurities, the amounts of zinc were as large as 2.7 to 5.7 mass ppm, and the amounts of lead were as large as 0.5 to 16 mass ppm.

Judging from these results, it is apparent that only low quality electrolytic copper of 99.99 mass % or lower in purity can be obtained.

Also, the dendrites obtained in Comparative Examples 8 through 14 were several millimeters to 30 mm in particle size, which are larger than those obtained in Examples.

TABLE 1

| | Zn | Fe | Ni | Pb | Bi | Sb | As | S | Ca | Na | Cl | Electrode |
|---|---|---|---|---|---|---|---|---|---|---|---|---|
| Embodiment 1-1 | <0.3 | <1 | <2 | <0.3 | <0.3 | <0.3 | <0.3 | 5 | <0.5 | 4 | 6 | Ti-Plate Wlded |
| Embodiment 1-2 | 0.4 | <1 | <2 | <0.3 | <0.3 | <0.3 | <0.3 | 3 | <0.5 | 5 | 11 | Electrode |
| Embodiment 2-1 | 0.3 | <1 | <2 | <0.3 | <0.3 | <0.3 | <0.3 | 5 | <0.5 | 5 | 9 | Ti-Wire Attached |
| Embodiment 2-2 | 0.5 | <1 | <2 | <0.3 | <0.3 | <0.3 | <0.3 | 7 | <0.5 | 6 | 12 | Electrode |
| Comparative Example 1 | 1.9 | <1 | <2 | 2.6 | <0.3 | 0.4 | <0.3 | 5 | 2.5 | 25 | 56 | Normal Flat-type |
| Comparative Example 2 | 2.6 | <1 | <2 | 0.5 | <0.3 | 0.5 | <0.3 | 5 | <0.5 | 20 | 60 | Electrode |
| Comparative Example 3 | 1 | <1 | <2 | 0.4 | <0.3 | 0.3 | <0.3 | 5 | 3.0 | 23 | 47 | |
| Comparative Example 4 | 1 | <1 | <2 | 0.4 | <0.3 | <0.3 | <0.3 | 3 | <0.5 | 25 | 45 | |
| Comparative Example 5 | 2.4 | <1 | <2 | 1.9 | 0.6 | 0.7 | <0.3 | 8 | 2.2 | 35 | 78 | |
| Comparative Example 6 | 1.9 | <1 | <2 | 0.6 | 0.4 | 1.6 | <0.3 | 7 | 3.6 | 32 | 58 | |
| Comparative Example 7 | 3.1 | <1 | <2 | 0.7 | 0.7 | 0.8 | <0.3 | 8 | 4.3 | 30 | 71 | |
| Comparative Example 8 | 2.7 | <1 | <2 | 0.5 | 0.4 | 1.0 | <0.3 | 7 | 5.2 | 28 | 61 | Corrugated Electrode |
| Comparative Example 9 | 3 | <1 | <2 | 0.7 | <0.3 | <0.3 | <0.3 | 4 | 3.1 | 34 | 110 | |
| Comparative Example 10 | 2.7 | <1 | <2 | 0.6 | <0.3 | <0.3 | <0.3 | 4 | <0.5 | 30 | 91 | |
| Comparative Example 11 | 14 | <1 | <2 | 16 | 1 | 0.5 | 0.7 | 8 | 3.3 | 28 | 72 | |
| Comparative Example 12 | 5.7 | <1 | <2 | 5.8 | <0.3 | <0.3 | <0.3 | 7 | <0.5 | 23 | 54 | |
| Comparative Example 13 | 5.5 | <1 | <2 | 1.5 | 0.8 | 0.7 | 0.3 | 10 | 2.2 | 28 | 58 | |
| Comparative Example 14 | 2.9 | <1 | <2 | 1.3 | 0.3 | <0.3 | <0.3 | 8 | 0.8 | 29 | 52 | |

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. High purity electrolytic copper of more than 99.99% in purity, in dendrite particle form, wherein said high purity copper is obtained through electrowinning in a halide bath, and wherein more than 95 mass % of the particles are 3.0 mm or smaller in particle size.

2. A method of producing high purity electrolytic copper through halide-bath electrowinning, comprising the steps of:

providing a cathode having convex sections being 3 aim or smaller in width and having side surfaces at an angle of 80 to 110 degrees;

growing copper in the form of dendritic crystals, the copper being deposited on said cathode; and recovering growth ends of 3.0 mm or shorter from tops of the dendritic copper crystals.

3. The method as claimed in claim 2, wherein electrolysis is performed while adjusting current so that the potential of the cathode stays in the range of−50 to −150 mV/SHE.

4. The method as claimed in claim 2, wherein the cathode has insulated concave section.

5. The method as claimed in claim 3, wherein the cathode has insulated concave sections.

6. The method as claimed in claim 4, wherein all electrodeposits or almost all electrodeposits are scraped off the convex sections of the cathode at regular time intervals.

7. The method as claimed in claim 5, wherein all electrodeposits or almost all electrodeposits are scraped off the convex sections of the cathode at regular lime intervals.

8. The method as claimed in any of claims 4 to 7, wherein the convex sections are made of Ti or Cu.

* * * * *